US006053023A

United States Patent [19]

Landrum

[11] Patent Number: 6,053,023

[45] Date of Patent: Apr. 25, 2000

[54] METHOD OF COLD FORGING A WORKPIECE HAVING A NON-CIRCULAR OPENING

[75] Inventor: Richard L. Landrum, Temperance, Mich.

[73] Assignee: Flowform, Inc., Toledo, Ohio

[21] Appl. No.: 09/109,526

[22] Filed: Jul. 2, 1998

[51] Int. Cl.[7] ..... B21K 21/12

[52] U.S. Cl. ..... 72/355.4; 72/358

[58] Field of Search ..... 72/325, 354.6, 72/354.8, 355.4, 358, 370.01, 370.23, 370.26; 29/898.048

[56] References Cited

U.S. PATENT DOCUMENTS

| | | | |
|---|---|---|---|
| 2,527,787 | 10/1950 | Berger . | |
| 3,063,744 | 11/1962 | Flumerfelt . | |
| 3,197,842 | 8/1965 | Parker . | |
| 3,253,330 | 5/1966 | Davies . | |
| 3,411,815 | 11/1968 | Sullivan, Jr. . | |
| 3,530,495 | 9/1970 | Kindel . | |
| 3,560,035 | 2/1971 | Kindel . | |
| 3,571,882 | 3/1971 | Andrew . | |
| 3,574,369 | 4/1971 | Andrew . | |
| 3,574,370 | 4/1971 | Andrew . | |
| 3,638,976 | 2/1972 | Andrew . | |
| 3,647,249 | 3/1972 | Baba et al. . | |
| 3,677,587 | 7/1972 | Schmidt et al. . | |
| 3,787,127 | 1/1974 | Cutler . | |
| 3,969,030 | 7/1976 | Sullivan . | |
| 3,999,870 | 12/1976 | Clark et al. . | |
| 4,003,667 | 1/1977 | Gaines et al. . | |
| 4,038,860 | 8/1977 | Kanamaru et al. | 72/358 |
| 4,134,701 | 1/1979 | McEowen . | |
| 4,143,983 | 3/1979 | McEowen . | |
| 4,144,626 | 3/1979 | McEowen . | |
| 4,148,119 | 4/1979 | McEowen . | |
| 4,381,594 | 5/1983 | Levande et al. | 72/370.01 |
| 4,430,016 | 2/1984 | Matsuoka et al. . | |
| 4,463,590 | 8/1984 | Theobald . | |
| 4,527,924 | 7/1985 | Asberg . | |
| 4,543,812 | 10/1985 | Theobald . | |
| 4,577,989 | 3/1986 | Ito . | |
| 4,790,682 | 12/1988 | Henkel . | |
| 5,011,320 | 4/1991 | Love et al. . | |
| 5,290,203 | 3/1994 | Krude . | |

*Primary Examiner*—Lowell A. Larson
*Attorney, Agent, or Firm*—MacMillan, Sobanski & Todd, LLC

[57] ABSTRACT

A method and apparatus for cold forging a workpiece having a non-circular opening. The workpiece may be, for example, a ball joint housing having a non-circular opening in the bottom. The housing made be made of metal, such as carbon, alloy and stainless steels, aluminum, titanium, brass, copper, and high-temperature alloys that contain cobalt, nickel or molybdenum. The non-circular opening is preferably oblong in shape for providing uni-axial movement of a toggle or shaft. The workpiece is preferably cold forged using the backward extrusion process in which the metal flows back and around the descending punch or ram. The punch and stool are designed such that they are slightly more elongated in the transverse direction than the non-circular opening in order to compensate for the tendency for the finished workpiece to be elongated in the longitudinal direction due to the cold forging process. The punch and stool are also designed with an opening to allow space for any excess metal to flow in order to relieve the pressure during formation of the workpiece.

17 Claims, 9 Drawing Sheets

METHOD OF COLD FORGING A WORKPIECE HAVING A NON-CIRCULAR OPENING

BACKGROUND OF THE INVENTION

This invention relates in general to cold forging a workpiece, and in particular, to a method of cold forging a ball joint housing having a non-circular opening.

Forging is a manufacturing process by which metal is plastically deformed beyond its yield point under great pressure into high-strength parts. The process is normally (but not always) performed hot by preheating the metal to a desired temperature. It is important to note that the forging process is entirely different from the casting (or foundry) process, in which the metal used is melted, then poured or injected into a die.

There are four basic methods used to make a forged part: (1) Impression Die Forging, (2) Open Die Forging, (3) Seamless Rolled Ring Forging, and (4) Cold Forging. Impression die forging plastically deforms metal between two dies that contain a precut profile of the desired part. Parts weighing from ounces to 60,000 lbs. can be made using this process. Commonly referred to as closed-die forging, impression-die forging of steel, aluminum, titanium and other alloys can produce an almost limitless variety of 3-D shapes that range in weight from mere ounces up to more than 25 tons. Impression-die forging is routinely practiced using hydraulic presses, mechanical presses and hammers, with capacities up to 50,000 tons, 20,000 tons and 50,000 lbs. respectively. As the name implies, two or more dies containing impressions of the part shape are brought together as forging stock undergoes plastic deformation. Because metal flow is restricted by the die contours, this process can yield more complex shapes and closer tolerances than open-die forging processes. Additional flexibility in forming both symmetrical and non-symmetrical shapes comes from various preforming operations (sometimes bending) prior to forging in finisher dies. The geometry for a part can range from some of the easiest to forge simple spherical shapes, block-like rectangular solids, and disc-like configurations to the most intricate components with thin and long sections that incorporate thin webs and relatively high vertical projections like ribs and bosses. Although many parts are generally symmetrical, others incorporate all sorts of design elements (flanges, protrusions, holes, cavities, pockets, etc.) that combine to make the forging very non-symmetrical. In addition, parts can be bent or curved in one or several planes, whether they are basically longitudinal, equi-dimensional or flat. Most engineering metals and alloys can be forged via conventional impression-die processes, among them: carbon and alloy steels, tool steels, and stainless steels, aluminum and copper alloys, and certain titanium alloys. Strain-rate and temperature-sensitive materials (magnesium, highly alloyed nickel-based superalloys, refractory alloys and some titanium alloys) may require more sophisticated forging processes and/or special equipment for forging in impression dies. Larger parts up to 200,000 lbs. and 80 feet in length can be hammered or pressed into shapes this way.

Open-die forging can produce forging from a few pounds up to more than 150 tons. Called open-die because the metal is not confined laterally by impression dies during forging, this process progressively works the starting stock into the desired shape, most commonly between flat-faced dies. In practice, open-die forging comprises many process variations, permitting an extremely broad range of shapes and sizes to be produced. In fact, when design criteria dictate optimum structural integrity for a huge metal component, the sheer size capability of open-die forging makes it the clear process choice over non-forging alternatives. At the high end of the size range, open-die forging is limited only by the size of the starting stock, namely, the largest ingot that can be cast. Practically all forgeable ferrous and non-ferrous alloys can be open-die forged, including some exotic materials like age-hardening superalloys and corrosion-resistant refractory alloys. Open-die shape capability is indeed wide in latitude. Not unlike successive forging operations in a sequence of dies, multiple open-die forging operations can be combined to produce the required shape. At the same time, these forging methods can be tailored to attain the proper amount of total deformation and optimum grain-flow structure, thereby maximizing property enhancement and ultimate performance for a particular application. Forging an integral gear blank and hub, for example, may entail multiple drawing or solid forging operations, then upsetting. Similarly, blanks for rings may be prepared by upsetting an ingot, then piercing the center, prior to forging the ring.

Seamless rolled ring forging is typically performed by punching a hole in a round piece of metal (creating a donut shape) and then rolling and squeezing (or in some cases, pounding) the donut into a thin ring. Ring diameters can range from a few inches to 30 feet. Rings forged by the seamless ring rolling process can weigh less than 1 lb. up to 350,000 lbs. Performance-wise, there is no equal for forged, circular-cross-section rings used in energy generation, mining, aerospace, off-highway equipment and other critical applications. Seamless ring configurations can be flat (like a washer), or feature higher vertical walls (approximating a hollow cylindrical section). Heights of rolled rings range from less than an inch up to more than 9 ft. Depending on the equipment utilized, wall-thickness/height ratios of rings typically range from 1:16 up to 16:1, although greater proportions have been achieved with special processing. In fact, seamless tubes up to 48-in. diameter and over 20-ft long are extruded on 20 to 30,000-ton forging presses. Even though basic shapes with rectangular cross-sections are the norm, rings featuring complex, functional cross-sections can be forged to meet virtually any design requirements. Aptly named, these contoured rolled rings can be produced in thousands of different shapes with contours on the inside and/or outside diameters. A key advantage to contoured rings is a significant reduction in machining operations. Not surprisingly, custom-contoured rings can result in cost-saving part consolidations. Compared to flat-faced seamless rolled rings, maximum dimensions (face heights and O.D.'s) of contoured rolled rings are somewhat lower, but are still very impressive in size. High tangential strength and ductility make forged rings well-suited for torque- and pressure-resistant components, such as gears, engine bearings for aircraft, wheel bearings, couplings, rotor spacers, sealed discs and cases, flanges, pressure vessels and valve bodies. Materials include not only carbon and alloy steels, but also non-ferrous alloys of aluminum, copper and titanium, as well as nickel-base alloys.

Most forging is done as hot work, at temperatures up to 2300 degrees F, however, a variation of impression die forging is cold forging. Cold forging encompasses many processes—bending, cold drawing, cold heading, coining, extrusions and more, to yield a diverse range of part shapes. The temperature of metals being cold forged may range from room temperature to several hundred degrees. Cold forging encompasses many processes such as bending, cold drawing, cold heading, coining, extrusion, punching, thread rolling and more to yield a diverse range of part shapes. These include various shaft-like components, cup-shaped geometry's, hollow parts with stems and shafts, all kinds of upset (headed) and bent configurations, as well as combinations of these components. Most recently, parts with radial flow like round configurations with center flanges, rectangular parts, and non-axisymmetric parts with 3- and 6-fold symmetry have been produced by warm extrusion. With cold forging of steel rod, wire, or bar, shaft-like parts with 3-plane bends and headed design features are not uncommon. Typical parts are most cost-effective in the range of 10 lbs. or less: symmetrical parts up to 7 lbs. readily lend themselves to automated processing. Material options range form lower-alloy and carbon steels to 300 and 400 series stainless steel, selected aluminum alloys, brass and bronze. There are times when warm forging practices are selected over cold forging especially for higher carbon grades of steel or where in-process anneals can be eliminated. Often chosen for integral design features such as built-in flanges and bosses, cold forging is frequently used in automotive steering and suspension parts, antilock-braking systems, hardware, defense components, and other applications where high strength, close tolerances and volume production make them an economical choice.

In the cold forging process, a chemically lubricated bar slug is forced into a closed die under extreme pressure. The unheated metal thus flows into the desired shape. There are three basic cold forging process operations: (1) Forward Extrusion, (2) Backward Extrusion, and (3) Upsetting, or Heading. In forward extrusion, the metal flows in the direction of the ram force to reduce slug diameter and increases its length to produce parts such as stepped shafts and cylinders. In backward extrusion, the metal flows back and around the descending punch opposite to the ram force to form hollow and cup-shaped parts. In upsetting, the metal flows at right angles to the ram force, increasing diameter and reducing length to gather the metal in the head and other sections along the length of the part to form flattened parts, such as fasteners and the like.

The cold forging process has several distinct advantages over other types of metal fabrication techniques. One advantage is the capability to form net shape parts and reduce material usage and scrap up to 50% over other forming processes. High throughput rates and the elimination of slow secondary machining operations contribute to reduced part cost over fabrication methods. Also, cold forging can flow metals into a wide variety of the most complicated shapes with great precision. Many parts produced by cold forging cannot be duplicated economically by any other type of metal fabrication. In addition, cold forging offers a unique ability to effect metal grain structure, size and orientation through work hardening. Thus, electrical/mechanical characteristics, hardness and other mechanical properties can be enhanced with the cold forging process. Further, cold forging can achieve better smoothness without secondary operations than other types of metal fabrication processes. This contributes to both the appearance and the economy of the part. Finally, cold forging can utilize a wide variety of metals to produce parts that perform as specified.

One of the variety of complicated shapes that can be formed using the cold forging operation is a net shape or near net shape housing for a ball joint having a circular opening in the bottom of the housing. The circular opening in the bottom of the housing permits movement of the toggle or shaft in the x- and y-directions to provide a 360 degree range of motion for the toggle or shaft.

Although cold forging can be used to form a variety of complicated shapes, cold forging a ball joint housing having a non-circular opening, rather than circular opening was believed to be impossible. One difficulty expected to be encountered is that the punch and stool would come in contact with each other and therefore be destroyed by the enormously large capacity of the press. Another expected difficulty is that the incorporation of the non-circular opening during cold forging would tend to misshape the final product, thereby making it slightly non-circular along the longitudinal axis of the non-circular opening. Consequently, in the conventional manufacture of ball joint housings, the housing is cold forged with a circular opening, rather than a non-circular opening, and then milled to form the non-circular opening, resulting in a more time-consuming and costly practice.

SUMMARY OF THE INVENTION

It is an object of the invention to provide a method of cold forging a workpiece without the need to mill the non-circular opening in a separate operation.

It is another object of the invention to provide a net shape or near net shape method of cold forging a ball joint housing with a non-circular opening.

It is yet another object of the invention to provide a method of forming a ball joint housing having a non-circular opening, where the method compensates for the tendency of the finished part to be elongated in the orthogonal direction due to the cold forging process.

It is still another object of the invention to provide an apparatus for cold forging a workpiece in which the punch and stool are designed to include a space for allowing excess metal to flow to relieve the pressure during formation of the workpiece.

To achieve these and other objects, this invention relates to a method and apparatus for cold forging a workpiece, for example, a housing for a ball joint having a non-circular opening in the bottom thereof. The preferred method of the invention comprises the steps of:

(a) upsetting the workpiece;

(b) backward extruding the workpiece;

(c) piercing the workpiece; and (d) coining the workpiece to form a non-circular opening in the workpiece.

An optional step of (e) piercing and trimming the workpiece subsequent to the coining step may be performed to further provide finishing details to the workpiece. A different apparatus is used for each of the above-mentioned steps (a)–(e).

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
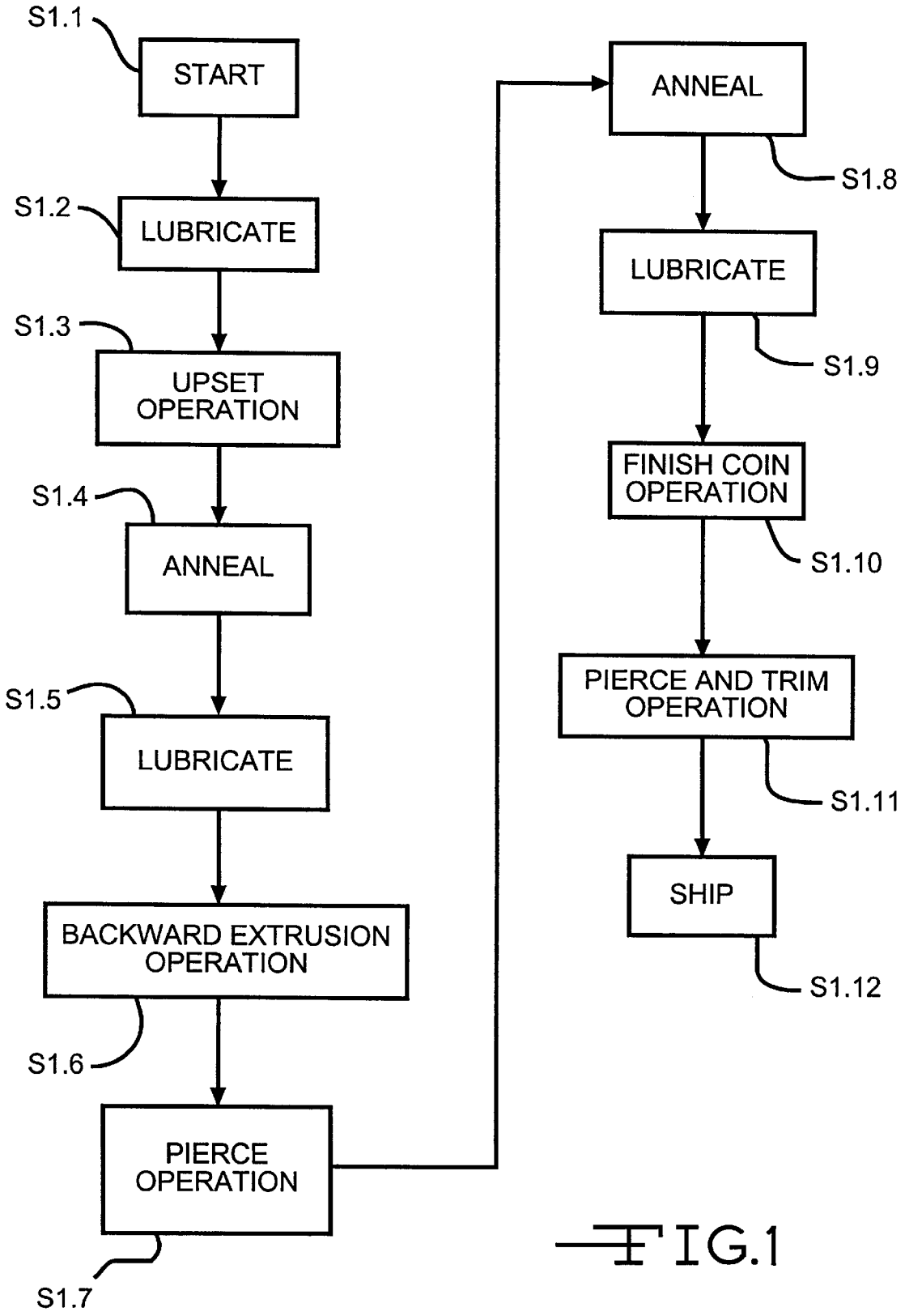
FIG. 1 is a flowchart of a preferred method of the invention of cold forging a workpiece having a non-circular opening.

Referring now to the drawings, there is illustrated in FIG. 1 a flow chart of the preferred method of cold forging a workpiece having a non-circular opening. The method begins at the start (Step S1.1) by providing a solid, cylindrical-shaped blank. The blank is indicated at 10 in FIG. 2, where it is shown after the upset operation. Preferably, the blank is made of 1018 low-carbon steel and has a height of approximately 1.580 inches and a diameter of approximately 1.125 inches. For a blank made of 1018 low-carbon steel, the blank 10 will have a weight of approximately 0.443 to 0.449 lbs. (201.0 to 203.7 gm.). However, it should be realized that the preferred method of the invention can be practiced with other types of blanks having various diameters and weights.

Figure 2:
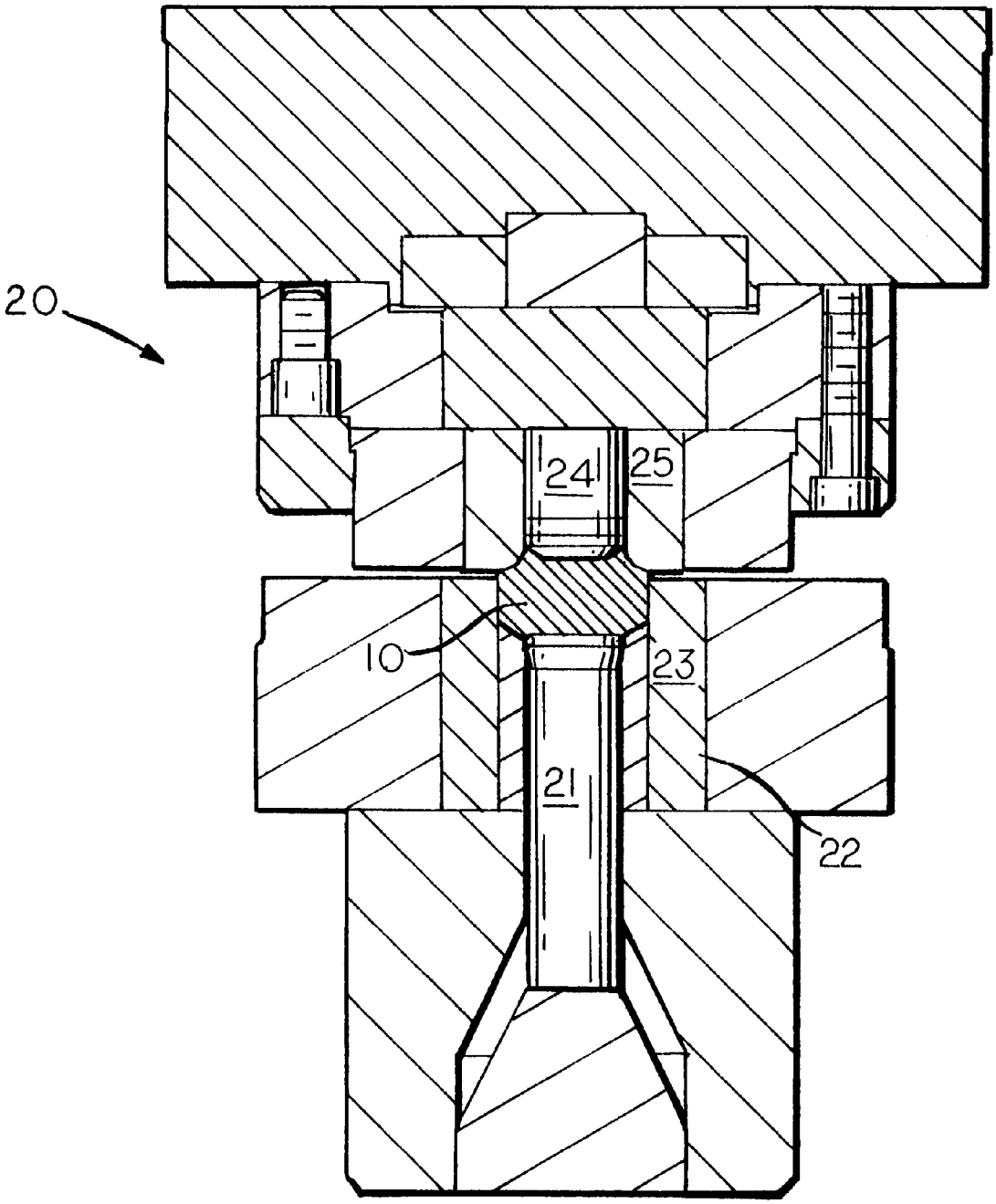
FIG. 2 is a cross-sectional view in elevation of a press used in an upset operation according to the preferred method of the invention.

In preparation of the cold forging operation, the blank is lubricated with a phosphorus solution and soap (Step S1.2) in a manner well known in the art. Next, an upset operation is performed on the blank (Step S1.3). To upset the blank 10, the blank 10 is placed within the press, shown generally at 20 in FIG. 2. The blank 10 is placed on top of a punch stool 21. The punch stool 21 is held in place by an inner coin insert 22, which in turn, is held in place by an outer coin insert 23. A punch 24 is driven downward by the press 20 to upset the blank 10. As the punch 24 is driven downward, the punch is guided by an upper coin insert 25. During the upsetting operation, the metal flows at right angles to the ram force, increasing diameter and reducing length of the blank 10, as shown in FIG. 2.

After the upset operation, the blank is then annealed (Step S1.4) in a manner well known in the art. Then, the blank 10 is lubricated (Step S1.5) using a phosphorus solution and soap in a manner similar to Step 1.2. In addition, the blank 10 may be treated with a solution of molybdenum di-sulphate or graphite solution, as is well known in the art.

Figure 3:
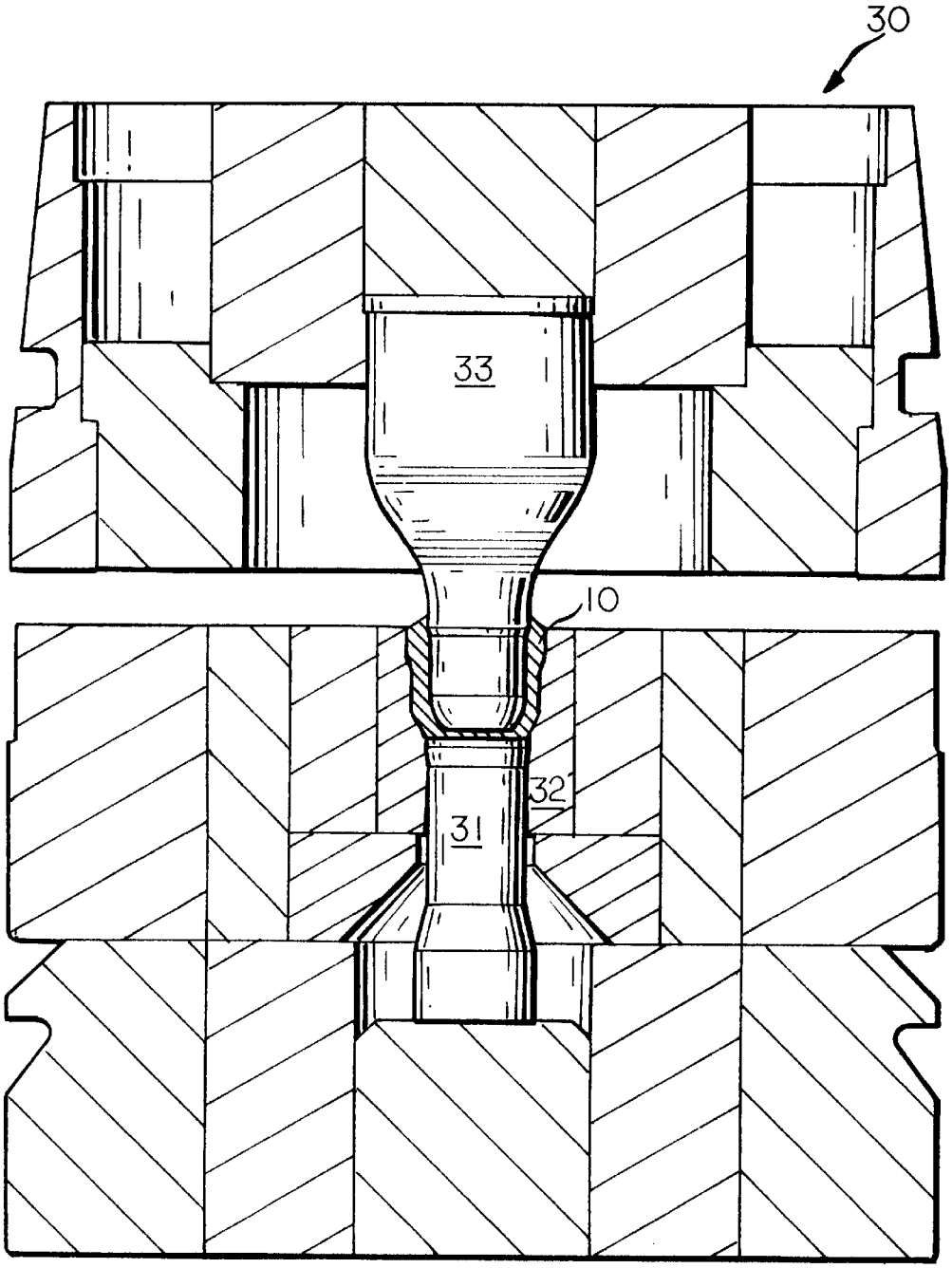
FIG. 3 a cross-sectional view in elevation of a press used in a backward extrusion operation according to the preferred method of the invention.

Next, a backward extrusion operation is performed on the blank 10 (Step S1.6). The backward extrusion operation is performed using the press, shown generally at 30 in FIG. 3. The blank 10 from the upsetting operation is placed on top of a punch stool 31 which is held in place by a lower coin insert 32. A punch 33 is driven downward by the press 30. During the backward extrusion operation, the metal flows back and around the descending punch 33 opposite to the punch force to form a generally cup-shaped blank 10, as shown in FIG. 3.

Figure 4:
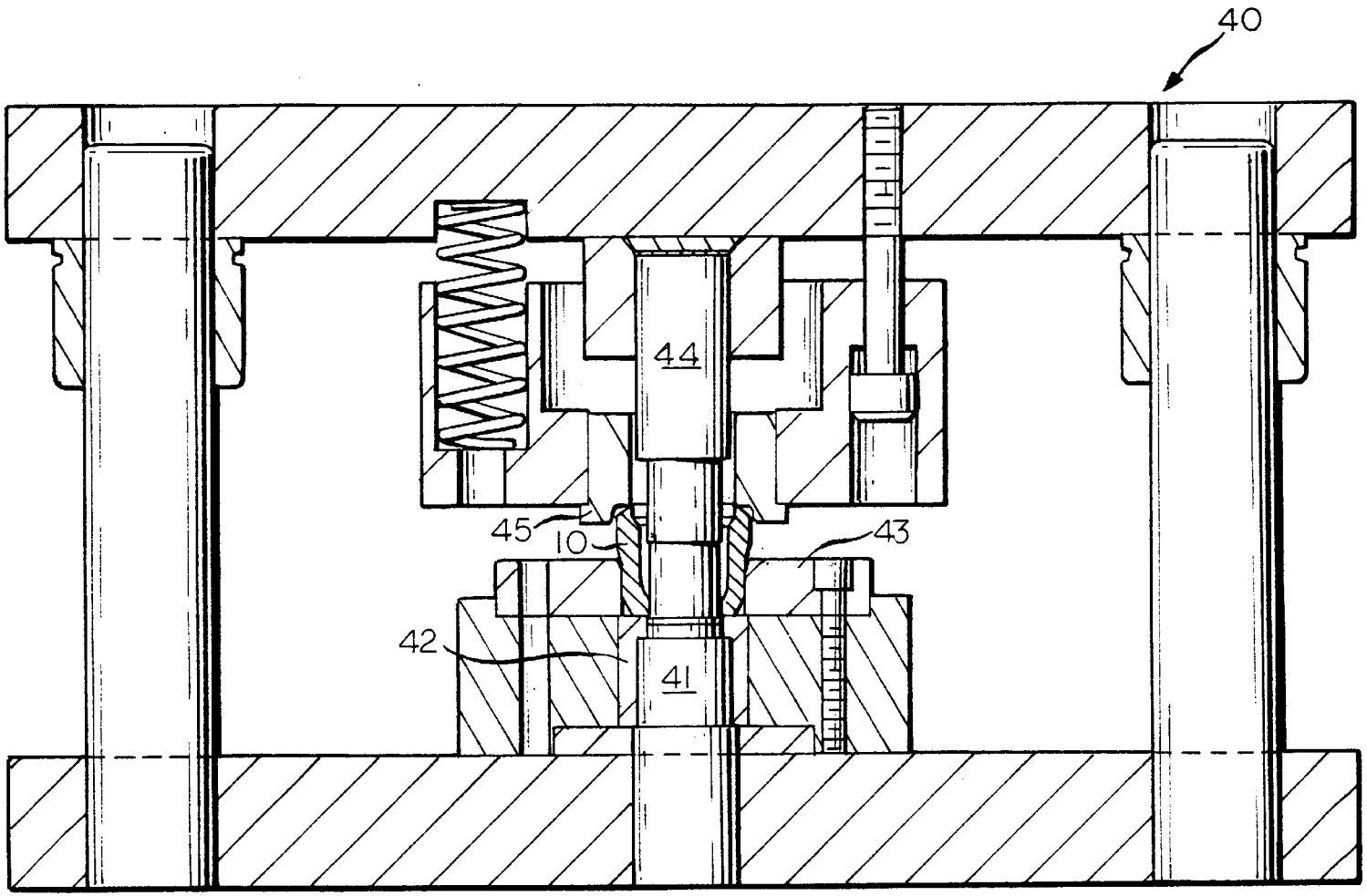
FIG. 4 is a cross-sectional view in elevation of a press used in a pierce operation according to the preferred method of the invention.

After the backward extrusion operation, a pierce operation is performed on the blank 10 (Step S1.7). The pierce operation pierces an opening in the bottom of the extruded blank 10 using a press, shown generally at 40 in FIG. 4. The blank 10 is placed on top of a pierce insert 41 which is held in place by a retainer 42. A locator block 43 is used to properly position the blank 10 and provides support for the blank 10 during the piercing operation. The press 40 drives a pierce punch 44 downward to pierce an opening in the bottom of the extruded blank 10. A stripper 45 supports the top portion of the blank 10 and the pierce punch 44 during the piercing operation.

Following the pierce operation, the blank is then annealed (Step S1.8) in a manner well known in the art. Then, the blank is lubricated (Step S1.9) using a phosphorus solution and soap in a manner similar to Step 1.2. In addition, the blank 10 may be treated with a solution of molybdenum di-sulphate or graphite solution, as is well known in the art.

Figure 5:
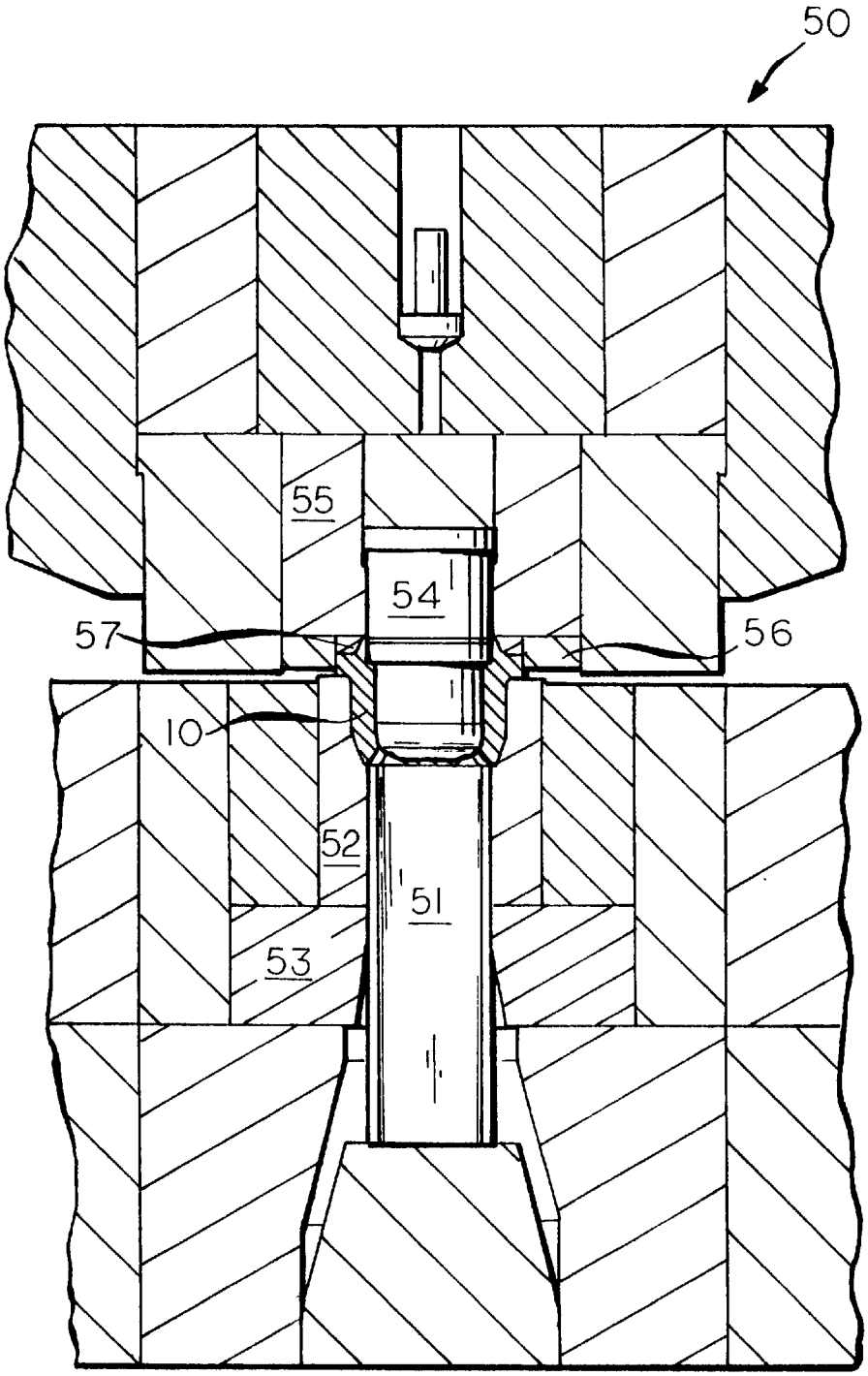
FIG. 5 is a cross-sectional view in elevation of a press used in a finish coin operation according to the preferred method of the invention.

An important step in the cold forging process of the invention is the finish coin operation (Step S1.10). In the finish coin operation, the pierced blank 10 is formed with a non-circular opening and other detailed features forming the finished product using a press, shown generally at 50 in FIG. 5. The pierced blank 10 is placed on top of a stool 51 which is supported by a lower coin insert 52 and a filler plate 53. The lower coin insert 52 also supports the blank 10. The press 50 drives a punch 54 downward into the blank 10 to form the finished product with a non-circular opening. A punch holder 55 supports the descending punch 54. The punch 50 includes an upper outer coin insert 56 and an upper inner coin insert 57 that engages the upper portion of the blank 10 during the finish coin operation to form the upper portion of the blank 10.

Figure 6:
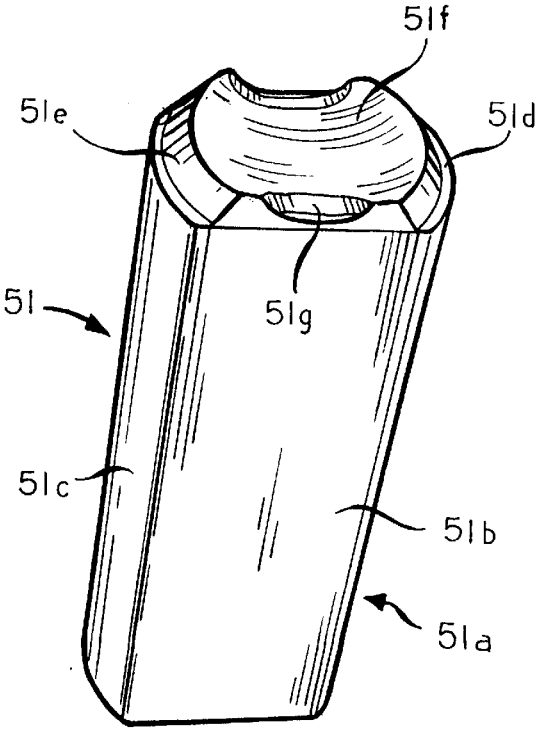
FIG. 6 is side perspective view of the stool used in the finish coin operation.

Referring now to FIG. 6, the stool 51 used in the finish coin operation is illustrated. The stool 51 includes a base portion 51*a* having a pair of substantially parallel side walls 51*b* connected by a pair of arcuate-shaped end walls 51*c*. The lower end of the stool 51 is substantially flat, while the upper end of the stool 51 includes a lip 51*d*, a pair of arcuate-shaped, upwardly extending walls 51*e*, and a generally parabolic, concave outer surface 51*f*. In addition, a pair of recesses 51*g* are formed in the upper end of the stool 51. Preferably, a pair of recesses 51*g* are positioned on opposite sides (approximately 180 degrees) from each other.

Figure 7:
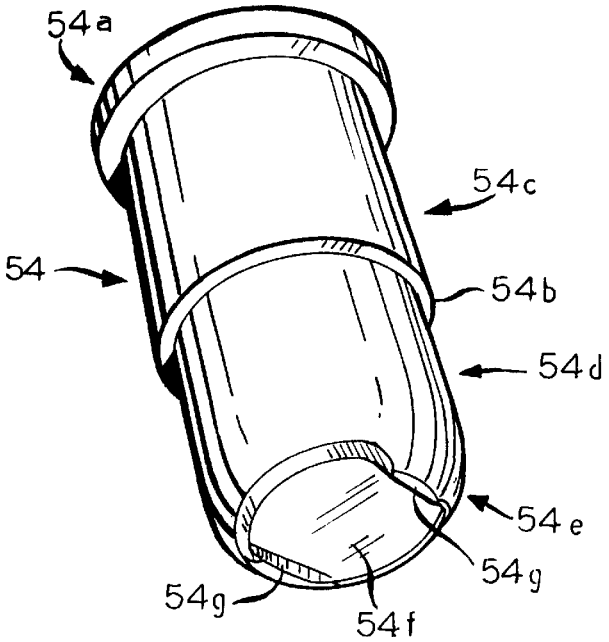
FIG. 7 is a side perspective view of the punch used in the finish coin operation.
Figure 8:
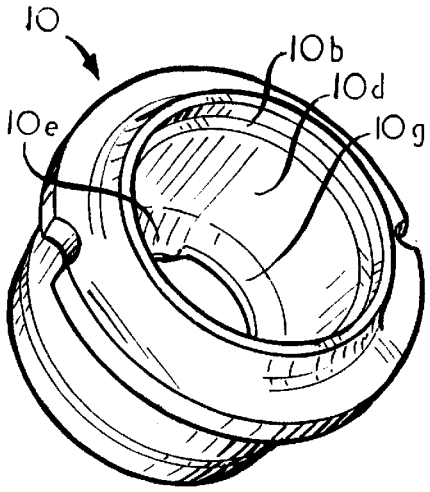
FIG. 8 is a side perspective view of the workpiece when viewing from the top of the workpiece after the finish coin operation.

Referring now to FIG. 7, the punch 54 used in the finish coin operation is illustrated. The punch 54 includes a substantially circular top portion 54*a*, a reduced-diameter, substantially circular middle portion 54*c* having a lip 54*b*, and a reduced-diameter, substantially circular bottom portion 54*d*. The bottom portion 54*d* includes a tapered end portion 54*e* having a substantially flat outer surface 54*f* and a pair of raised end portions 54*g*. Preferably, the raised end portions 54*g* are positioned on opposite sides (approximately 180 degrees) from each other. The raised end portions 54*g* are generally complementary in shape to the recesses 51*g* of the stool 51 such that the raised end portions 54*g* of the punch 54 are received within the recesses 51*g* of the stool 51. In addition, the substantially flat outer surface 54*f* of the punch 54, in combination with the parabolic outer surface 51*f* of the stool 51, allows any excess metal to flow into the parabolic outer surface 51*f* of the stool 51. In this manner, any damage to the stool 51 and the punch 54 may be avoided during the finish coin operation and any excess metal can be easily removed from the finished product during the subsequent pierce and trim operation to be discussed below. It should be realized that the invention can be practiced with any number of raised end portions having any position relative to each other.

Figure 9:
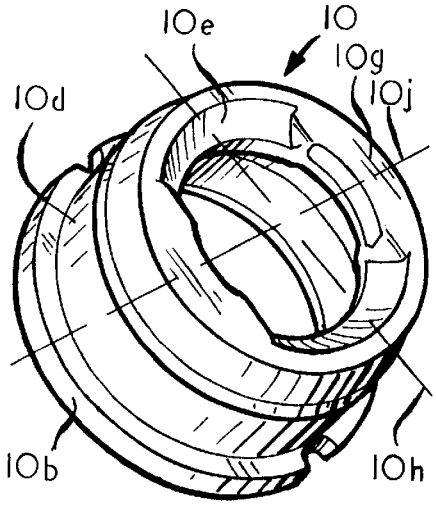
FIG. 9 is a side perspective view of the workpiece when viewing from the bottom of the workpiece after the finish coin operation.
Figure 10:
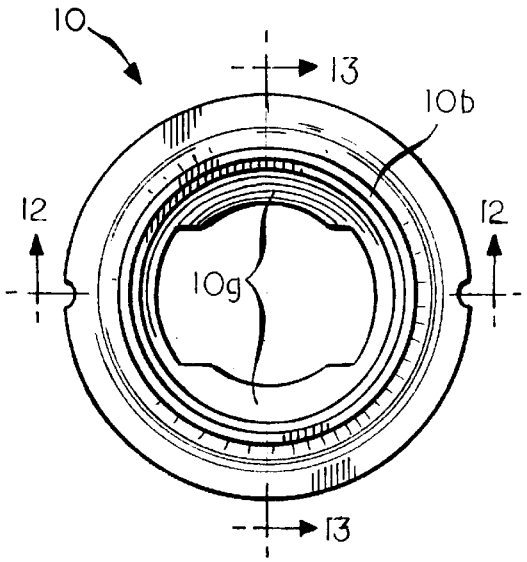
FIG. 10 is a top view of the workpiece after the finish coin operation.

In a conventional press, during the finish coin operation of the cold forging process, the formation of a non-circular opening in the final product would cause the final product to be slightly out-of-round. In particular, the final product would be misshaped such that the finished product would have a diametric length along the longitudinal axis 10*h* (shown in FIG. 9) is larger than the diametric length along the axis 10*j* that is orthogonal to the longitudinal axis.

In order to compensate for the misshape of the finished product that occurs using a conventional press, the lower coin insert 52 of the press 50 of the preferred method of the invention has a slightly non-uniform diameter depending on the size of the blank 10 of the finished product. Specifically, the diametric length along the longitudinal axis of the lower coin insert 52 is made smaller than the diametric length along the axis that is orthogonal to the longitudinal axis. The magnitude of non-uniformity depends on the size of the final product. For example, in order to form a finished product having a uniform outer diameter of approximately 1.6535 inches and a non-uniform opening in the bottom thereof, the lower coin insert 52 has a diametric length of approximately 1.6465 inches along the longitudinal axis and a diametric length of approximately 1.6485 inches along the axis orthogonal to the longitudinal axis.

FIGS. 8 through 13 show the blank 10 formed by the finish coin operation. The blank 10 is generally cup-shaped having a cylindrical side wall 10*d* formed by the bottom portion 54*d* of the punch 54. The cylindrical side wall 10*d* includes a tapered end portion 10*e* corresponding to the tapered end portion 54*e* of the punch 54. The top portion of the blank 10 includes a lip 10*b* formed by the lip 54*b* of the punch 54. The blank 10 also includes a pair of tapered end walls 10*e* formed by the pair of upwardly extending walls 51*e* of the stool 51. Opposite the tapered end walls 10*e*, the blank 10 includes a pair of arcuate-shaped bottom surfaces 10*g*. During the forming of the pair of arcuate-shaped bottom surfaces 10*g*, any excess metal flows through to the pair of recesses 51*g* and the parabolic outer surface 51*f* of the stool 51.

Figure 11:
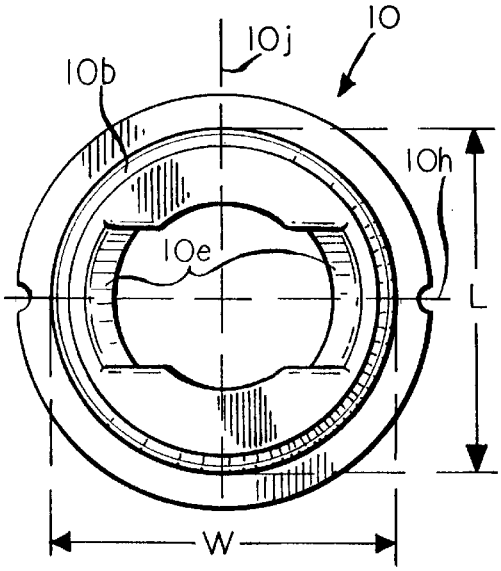
FIG. 11 is a bottom view of the workpiece after the finish coin operation.
Figure 12:
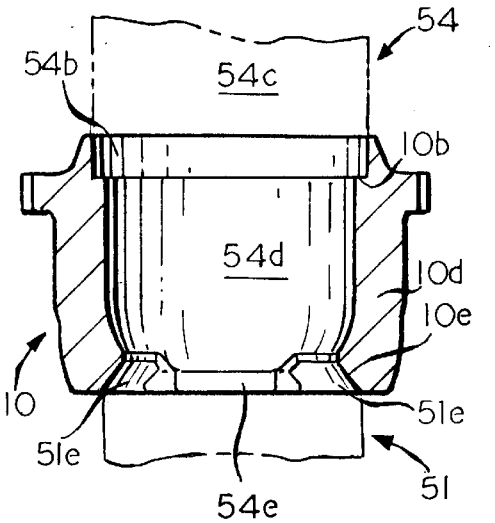
FIG. 12 is a cross-sectional view of the workpiece taken along line 12—12 of FIG. 10.
Figure 13:
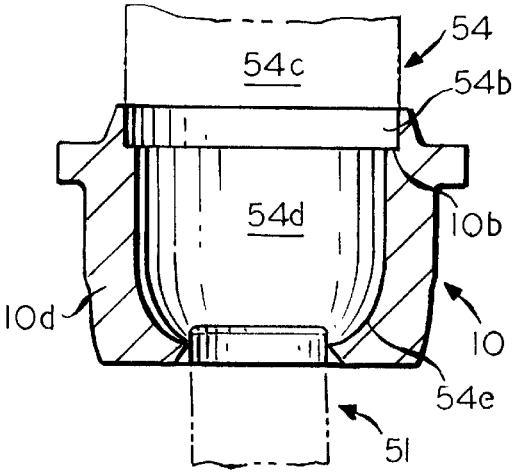
FIG. 13 is a cross-sectional view of the workpiece taken along line 13—13 of FIG. 10.

As best seen in FIG. 11, the diametric length, W, of the blank 10 along the longitudinal axis is equal to the diametric length, L, of the blank 10 along the axis orthogonal to the longitudinal axis, even though the blank 10 has a non-circular opening in the bottom thereof. As mentioned above, this is accomplished by cold forging the blank 10 using a lower coin insert 52 having a slightly smaller diametric length along the longitudinal axis, W, than along the axis, L, orthogonal to the longitudinal axis.

Figure 14:
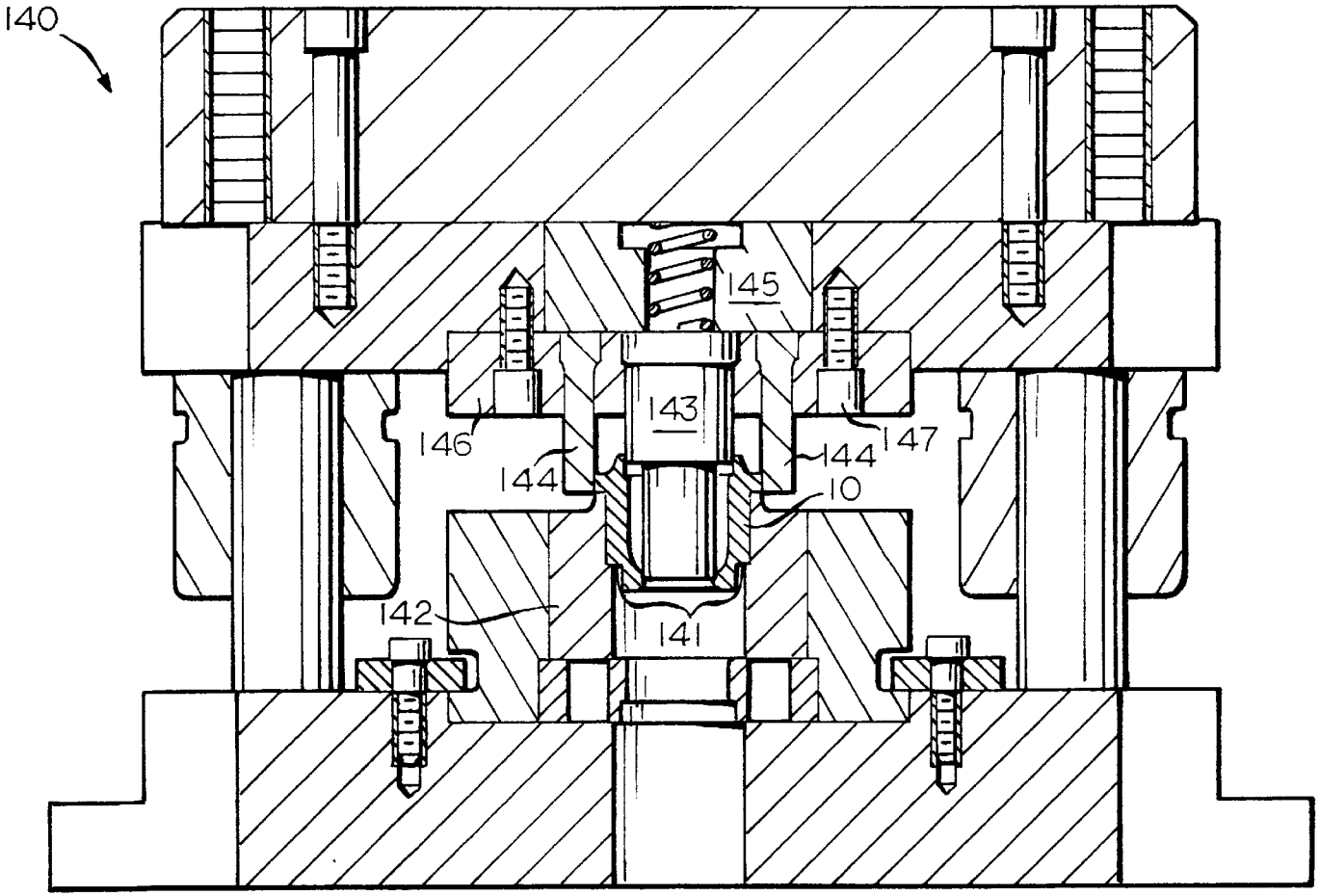
FIG. 14 is a cross-sectional view in elevation of a press used in a pierce and trim operation according to the preferred method of the invention.

Following the finish coin operation, the blank 10 may undergo a pierce and trim operation (Step S1.11). In the pierce and trim operation, the finished blank 10 may be pierced and trimmed to form other detailed features of the finished product, for example, a ball joint housing, using a press 140, generally shown in FIG. 14. In the press 140, a flange 141 of the blank 10 is supported by a trim insert 142. The press 140 drives a punch 143 and a pair of trim punches 144 downward to form the finished product. In addition, a pair of stripper pins (not shown) may be included to form details on the finished product. The pair of trim punches 144 and the pair of stripper pins (not shown) extend downwardly from a backup plug 145 and an upper retainer 146. The upper retainer 146 may be securely fastened to the press 140 by using well-known fastening means 147, such as bolts, and the like. After the pierce and trim operation, the finished product can then be shipped to the consumer (Step S1.12).

Figure 15:
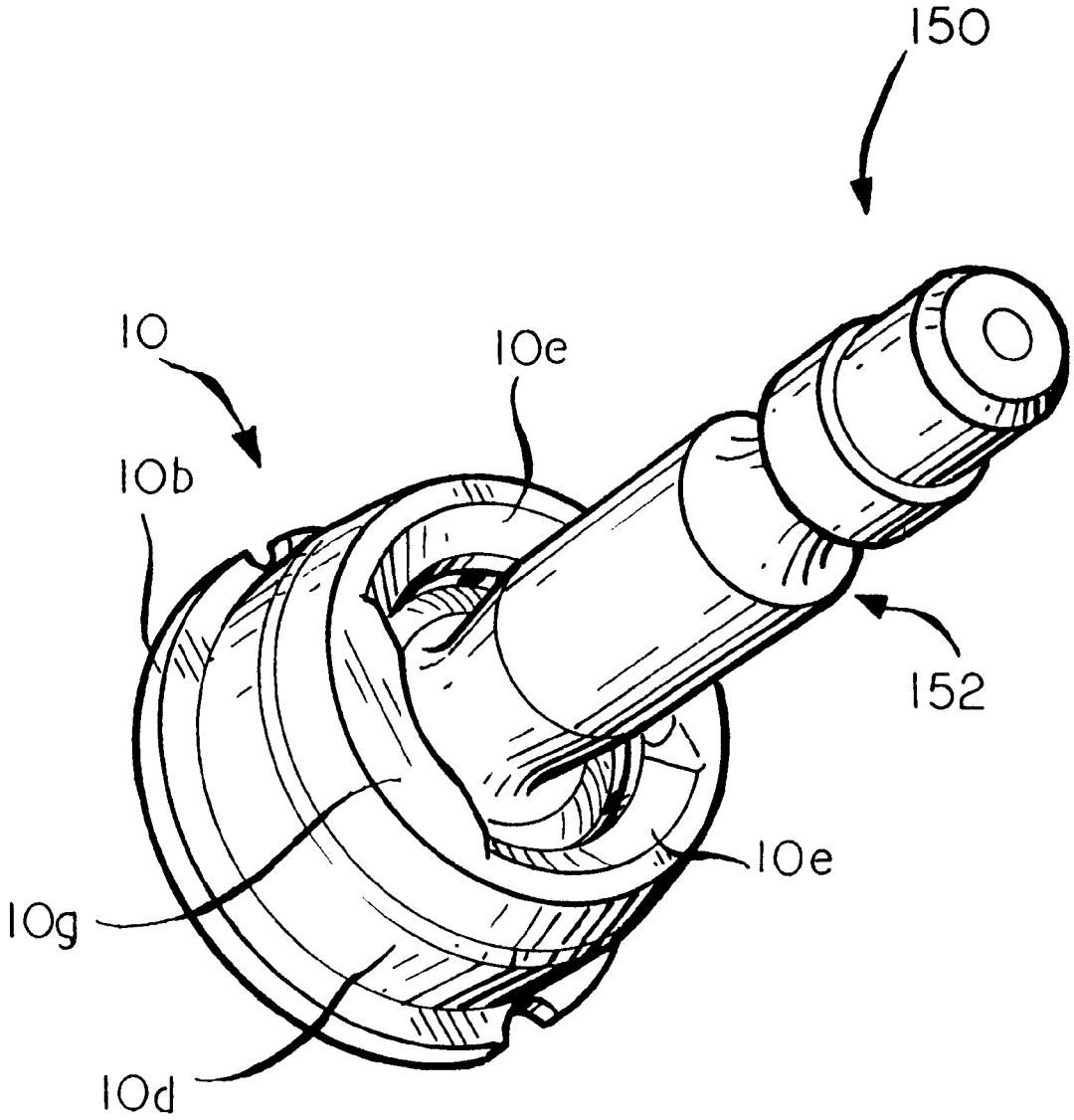
FIG. 15 is a side perspective view of a ball joint having a ball joint housing with a non-circular opening on the bottom thereof formed using the preferred method of the invention.

FIG. 15 illustrates the blank or finished product being used as a housing 10 having a non-circular opening in the bottom thereof. The housing 10 may be used, for example, as a ball joint housing 150 by providing a shaft, shown generally at 152, having one end that is rotatably inserted into the housing 10. The ball joint 150 may also include a sleeve (not shown) inserted into the housing for allowing the shaft 152 to freely rotate within the housing 10.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of cold forging a workpiece having a non-circular opening, the method comprising the steps of:

(a) upsetting the workpiece;

(b) backward extruding the workpiece;

(c) piercing the workpiece; and (d) coining the workpiece to form a non-circular opening in the workpiece by using a press, the press including a punch stool for supporting the workpiece, a filler plate for supporting the punch stool, a punch, a punch holder for supporting the punch, an upper outer coin insert for engaging an upper portion of the workpiece, an upper inner coin insert for engaging the upper portion of the workpiece, and a lower coin insert having a non-uniform diameter, the non-uniform diameter of the lower coin insert is such that a diametric length along a longitudinal axis is smaller than a diametric length orthogonal to the longitudinal axis.

2. The method of claim 1, further including the step of piercing and trimming the workpiece subsequent to said coining step.

3. The method of claim 2, wherein said piercing and trimming step is performed using a press comprising a punch stool for supporting the workpiece, a locator for supporting said punch stool and for positioning the workpiece, a punch, a pair of trim punches for engaging a top portion of the workpiece, and a backup plug or supporting said pair of trim punches.

4. The method of claim 1, further including the step of annealing and lubricating the workpiece prior to said extruding step.

5. The method of claim 1, further including the step of annealing and lubricating the workpiece prior to said coining step.

6. The method of claim 1, where said upsetting step is performed using a press comprising a punch stool for supporting the workpiece, an inner coin insert for supporting said punch stool, a punch for upsetting the workpiece, and an upper coin insert for guiding said punch when upsetting the workpiece.

7. The method according to claim 1, wherein said backward extruding step is performed using a press comprising a punch stool for supporting the workpiece, a lower coin insert for supporting said punch stool and the workpiece, and a punch for forming a generally cup-shaped workpiece.

8. The method according to claim 1, wherein said piercing step is performed using a press comprising a punch stool for supporting the workpiece, a lower pierce insert for supporting said punch stool, a locator block for positioning and supporting the workpiece, a pierce punch for piercing the workpiece, and a stripper for supporting a top portion of the workpiece.

9. An apparatus for cold forging a workpiece having a non-circular opening, comprising:

a punch;

a punch stool for supporting the workpiece;

a filler plate for supporting said punch stool;

a punch holder for supporting said punch;

an upper outer coin insert for engaging an upper portion of the workpiece;

an upper inner coin insert for engaging the upper portion of the workpiece; and a lower coin insert for supporting the workpiece, wherein said lower coin insert has a diametric length along a longitudinal axis smaller than a diametric length along an axis orthogonal to the longitudinal axis.

10. The apparatus according to claim 9, wherein one end of said punch stool includes a pair of arcuate-shaped, upwardly extending walls, a pair of recesses, and a generally parabolic, concave outer surface.

11. The apparatus according to claim 10, wherein one end of said punch includes a substantially circular bottom portion including a tapered end portion having a substantially flat outer surface, and a pair of raised end portions.

12. The apparatus according to claim 11, wherein the pair of recesses of said punch stool are complementary in shape to the pair of raised end portions of said punch.

13. The apparatus according to claim 11, wherein the substantially flat outer surface of said punch, in combination with the generally parabolic, concave outer surface of said punch stool, allows any excess metal to flow into the generally parabolic, concave outer surface of said punch stool during cold forging of the workpiece.

14. The apparatus according to claim 9, wherein the workpiece comprises a ball joint housing having a non-circular opening in the bottom thereof.

15. An apparatus for cold forging a ball joint housing, comprising:

a punch;

a stool for supporting a blank;

a filler plate for supporting said punch stool;

a punch holder for supporting said punch;

an upper outer coin insert for engaging an upper portion of the blank;

an upper inner coin insert for engaging the upper portion of the blank; and a lower coin insert for supporting the blank, said lower coin insert has a diametric length along a longitudinal axis smaller than a diametric length along an axis orthogonal to the longitudinal axis, wherein said apparatus is capable of cold forging a ball joint housing having a substantially uniform outer diameter and having a non-circular opening in the bottom thereof.

16. The apparatus according to claim 15, wherein one end of said stool includes a pair of arcuate-shaped, upwardly extending walls, a pair of recesses, and a generally parabolic, concave outer surface, and wherein one end of said punch includes a substantially circular bottom portion including a tapered end portion having a substantially flat outer surface, and a pair of raised end portions, the pair of recesses of said stool being complementary in shape to the pair of raised end portions of said punch.

17. The apparatus according to claim 16, wherein the substantially flat outer surface of said punch, in combination with the generally parabolic, concave outer surface of said stool, allows any excess metal to flow into the generally parabolic, concave outer surface of said stool during cold forging of the ball joint housing.

* * * * *